US011878780B1

(12) United States Patent
Aziz et al.

(10) Patent No.: US 11,878,780 B1
(45) Date of Patent: Jan. 23, 2024

(54) AUTONOMOUS HULL BIOFOULING CLEANING SYSTEM

(71) Applicant: UNITED ARAB EMIRATES UNIVERSITY, Al Ain (AE)

(72) Inventors: Muthanna Ahmed Aziz, Al Ain (AE); Waleed Khalil Ahmed, Al Ain (AE)

(73) Assignee: UNITED ARAB EMIRATES UNIVERSITY, Al Ain (AE)

( * ) Notice: Subject to any disclaimer, the term of this patent is extended or adjusted under 35 U.S.C. 154(b) by 0 days.

(21) Appl. No.: 18/206,749

(22) Filed: Jun. 7, 2023

(51) Int. Cl.
*B63B 59/10* (2006.01)
*B63B 59/08* (2006.01)
(Continued)

(52) U.S. Cl.
CPC ..... *B63B 59/10* (2013.01); *B63B 35/38* (2013.01); *B63B 43/08* (2013.01); *B63B 59/08* (2013.01)

(58) Field of Classification Search
CPC ... B63B 59/06; B63B 59/08; B63B 2059/082; B63B 2059/085; B63B 2059/087; B63B 59/10; B63G 8/001; B63G 2008/002; B63G 2008/004; B08B 1/00; B08B 1/002; B08B 1/04
See application file for complete search history.

(56) References Cited

U.S. PATENT DOCUMENTS 5,174,222 A * 12/1992 Rogers ..... B63B 59/08 114/222
5,947,051 A 9/1999 Geiger
(Continued)

FOREIGN PATENT DOCUMENTS

BR 202019012783 U2 * 12/2020 ..... B63B 59/08
CN 111098994 B 2/2021
KR 102321006 B1 * 11/2021 ..... B63B 59/10

OTHER PUBLICATIONS

Nassiraei, Amir Ali Forough, Takashi Sonoda, and Kazuo Ishii. "Development of ship hull cleaning underwater robot." 2012 Fifth International Conference on Emerging Trends in Engineering and Technology. IEEE, 2012.
(Continued)

*Primary Examiner* — Ajay Vasudeva
(74) *Attorney, Agent, or Firm* — Nath, Goldberg & Meyer; Richard C. Litman

(57) ABSTRACT

The autonomous hull biofouling cleaning system includes a floating platform mounted on pontoons and having thrusters to move the platform close to a hull needing cleaning. The floating platform includes both axial and transverse sliding ballast to prevent the platform from overturning from the collection of debris. Mounted on the platform is a solar power apparatus for providing power to the various modules, a motorized hose reel, concentric hoses mounted on the reel, an ozone pumping apparatus, a vacuum debris collection apparatus, and modules for sanitizing the debris to discharge sanitized water. A submersible remotely operating cleaning system (SROCS) is attached to the hose and includes thrusters to move adjacent to the hull, electromagnetic coils to attach to the hull, and rubbing discs to remove the biofouling, the hose first pumping ozone on the biofouling and the vacuum debris hose removing the biofouling to the floating platform for processing.

11 Claims, 17 Drawing Sheets

(51) Int. Cl.
*B63B 35/38* (2006.01)
*B63B 43/08* (2006.01)

(56) References Cited

U.S. PATENT DOCUMENTS

| | | | | |
|---|---|---|---|---|
| 6,070,547 | A * | 6/2000 | Achord | B63B 59/10 114/222 |
| 7,811,513 | B2 * | 10/2010 | Johnson | B63B 59/08 422/38 |
| 9,308,977 | B2 * | 4/2016 | Andersen | B63G 8/001 |
| 9,434,456 | B2 * | 9/2016 | Højer | B08B 3/024 |
| 10,179,634 | B2 | 1/2019 | Van Rompay | |
| 2021/0107607 | A1 | 4/2021 | Gan | |
| 2021/0371062 | A1 | 12/2021 | Dyhrberg | |
| 2022/0324543 | A1 | 10/2022 | Loefler et al. | |

OTHER PUBLICATIONS

Cybernetix Magnetic Hull Crawler (MHC); downloaded on Mar. 7, 2023.
Fleet Cleaner Robot; printed on Mar. 7, 2023.
AOS Offshore Magnetic Hull Crawler; downloaded on Mar. 7, 2023.
SeaRobotics HullBUG; printed on Mar. 7, 2023.

* cited by examiner

AUTONOMOUS HULL BIOFOULING CLEANING SYSTEM

BACKGROUND

1. Field

The disclosure of the present patent application relates to boating apparatus, and particularly to an autonomous hull biofouling cleaning system for autonomous or semiautonomous removal of biofouling from the hull of a boat or ship while the vessel is still afloat.

2. Description of the Related Art

Biofouling, also known as biological fouling, is the accumulation of bacteria, plants, and algae on dampened surfaces causing structural or functional concerns. It's an undesirable collection of various aquatic organisms on maritime ships, and it will immediately impact any surface immersed in seawater. In general, fouling occurs substantially more rapidly in warm waters. There is a more considerable risk of fouling whenever ships spend long periods either idling or sailing at lower speeds. Besides, it is observed that biofouling accumulated at the discharge openings of the power plants and the nuclear stations would block the water flow and causes serious consequences.

A thick fouling layer can accumulate on the hull, significantly increasing friction against the water with considerable financial and environmental impacts. According to the International Maritime Organization (IMO), biofouling accounts for approximately 9% of all fuel consumed by ships, with an annual expense of around USD30 billion. Furthermore, biofouling accelerates the deterioration of the affected structures or surfaces, which causes increasing operational costs. Biofouling is associated with severe environmental issues. Overconsumption of fuel releases greenhouse gases, which harm the environment, resulting in the unnecessary release of 80-90 million metric tons of $CO_2$. However, emissions are not the only factor to consider. Hull biofouling also poses a substantial bio-security risk to marine ecosystems by spreading invasive aquatic species. And according to IMO, ship bio-fouling has a further negative impact on the entrance of invasive aquatic species than untreated ballast water.

The process of dry docking a boat or ship to clean the hull with land-based equipment is time-consuming, expensive, and labor-intensive, and removes the boat or ship from service during the process. Although some apparatus have been proposed for cleaning biofouling from the hull of boats and ships have been proposed, there is still a need for a system to remove biofouling from the hull of a vessel while it is afloat that is operable autonomously or semi-autonomously. Thus, an autonomous hull biofouling cleaning system solving the aforementioned problems is desired.

SUMMARY

The autonomous hull biofouling cleaning system includes a floating platform mounted on pontoons and having thrusters to move the platform close to a hull needing cleaning. The floating platform includes both axial and transverse sliding ballast to prevent the platform from overturning from the collection of debris. Mounted on the platform is a solar power apparatus for providing power to the various modules, a motorized hose reel, concentric hoses mounted on the reel, an ozone pumping apparatus, a vacuum debris collection apparatus, and modules for sanitizing the debris to return sanitized water to the body of water. A submersible remotely operating cleaning system (SROCS) is attached to the hose and includes thrusters to move adjacent to the hull, electromagnetic coils to attach to the hull, and rubbing discs to remove the biofouling, the hose first pumping ozone on the biofouling and the vacuum debris hose removing the biofouling to the floating platform for processing.

These and other features of the present subject matter will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
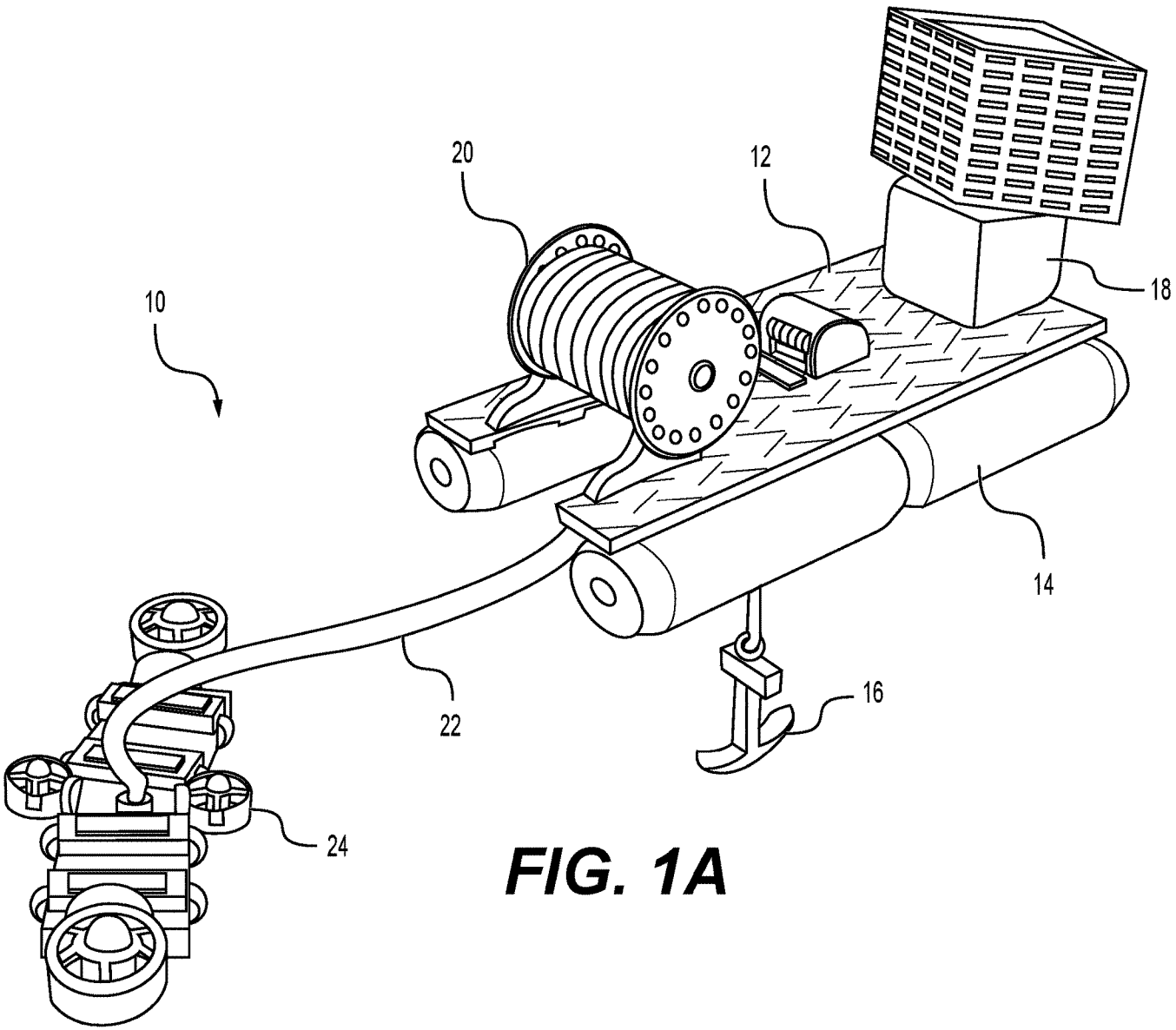
FIG. 1A is a perspective view of an autonomous hull biofouling cleaning system.

The autonomous hull biofouling cleaning system includes a floating platform mounted on pontoons and having thrusters to move the platform close to a hull needing cleaning. The floating platform includes both axial and transverse sliding ballast to prevent the platform from overturning from the collection of debris. Mounted on the platform is a solar power apparatus for providing power to the various modules, a motorized hose reel, concentric hoses mounted on the reel, an ozone pumping apparatus, a vacuum debris collection apparatus, and modules for sanitizing the debris to return sanitized water to the body of water. A submersible remotely operating cleaning system (SROCS) is attached to the hose and includes thrusters to move adjacent to the hull, electromagnetic coils to attach to the hull, and rubbing discs to remove the biofouling, the hose first pumping ozone on the biofouling and the vacuum debris hose removing the biofouling to the floating platform for processing.

Some features of the system include the hollow shape of the floating cylinders equipped with an axial Balancing mechanism for the right and the left side floating cylinders that includes a sliding cylindrical balancing weight connected with either an axial screw connected at one end with the motor to move the cylindrical balancing weight axially forward and backward based on the balancing requirements, or link to any axial mechanism like steel cable to perform the same axial motion. The cylindrical balancing weight contains smooth sliding bearing balls to reduce friction with the inner walls of the floating cylinders.

A stabilization actuation mechanism engages during operation to keep the floating platform stable and prevent it from flipping, as well as to protect the conveying system from damage. The mechanism responds to external disturbances that affect platform stability, particularly when sand and debris accumulate in the collection box, causing unbalanced impact, or when waves occur.

The system uses a motorized reel that holds a double wall hose, in which the inner pipe is connected to an ozonizer to feed ozone while cleaning the biofouling to eliminate and disinfect any trace of the removed biofouling, and the outer tube is connected to a vacuum system for sucking the eliminated biofouling and to transport it with seawater to the filter station. The beginning of the hose at the reel base is split into two split pipes, one goes to the ozonizer, and the other one goes to the vacuum station. The front side of the double hose is connected to the SROCS system. A two-way supply hose is connected to the SROCS from one side, and on the other side to a motorized reel system to supply and pull the hose during SROCS movement. It consists of an inner hose for supplying ozone from the platform to SROCS through a 12V DC air pump and an outer hose that that is connected to the vacuum extraction module for collecting the extracted biofouling and debris.

The structure of the floating system has two chassis, one connecting the floating cylinders, and the other is the main deck platform. The two chassis are sliding across each other through the sliding bracket for the aim of energy harvesting to create a relative motion.

The floating cylinders are hollow and can be split into two halves and connected by bolts and nuts for the maintenance, assembly, and disassembly process. The floating cylinders are hollow from the inside and can be injected with foam. Ballast can be attached to the lower half of the floating cylinder to perform the lower center of gravity of the system. The modular system has multiple hollow floating cylinders that are cascaded together by pipes sleeves and can be extended in the longitudinal and transverse directions. Floating cylinders can be shaped in a transverse direction for double, triple, and more columns, and connected by the system chassis to increase system payload capacity.

A sliding ballast resides inside the pipe sleeve and can be moved forward and backward via a controlled actuation mechanism fixed at one of the ends to balance the system's center of gravity and thus prevent flipping. The main control system controls the mechanism based on real-time feedback from the floating platform level sensor. A real-time closed-loop feedback control system is used to control the position of the sliding ballast based on the real-time actual floating platform level to maintain the system balance, especially when sand and debris are accumulate in the sand collection box, causing an unbalanced impact. The sliding ballast is surrounded by bearing balls to maintain smooth motion. The ballast can be extended by adding more weights through connected joints. Besides the axial balancing mechanism, the system has a transverse balancing mechanism at the front and the back of the platform, attached to the floating chassis that is made of a sliding bracket. The ballast has a curved shape to match the floating cylinder profile.

The Submersible Remotely Operated Cleaning System (SROCS) is an autonomous underwater robot equipped with an advanced motion control unit that enables the robot's orientation in the XYZ plane to be controlled. A nine-axis Inertial measurement unit (IMU) that consists of an accelerometer, gyroscope, and magnetometer to detect rotation in three-dimensional space is included.

An ultrasound sensor measures the distance between the SROCS and the hull surface, and when it reaches the surface, electromagnetic coils are excited to mount the SROCS on the surface, the thrusters are turned off, the cleaning process begins, and the motorized wheels move forward and backward.

A set of motorized main and secondary rubbing discs rotate to remove biofouling and debris from the ship's exterior. Debris and biofouling are guided to the center of the main disc, where the vacuum extraction module (VEM) will suck them up. SROCS includes the following modules: (1) an Advanced Motion Controller (AMC), which receives orientation in the XYZ plane and relative position to hull surface information from the navigation and surface inspection module and commands the four thrusters to achieve the desired position and orientation. The AMC excites the mounting electromagnetic coils and operates the cleaning discs and the motorized wheels, also commanding the motorized hose reel. (2) A Navigation and Surface Inspection Module (NSIM) that communicates in real time orientation in the XYZ plane and relative position with respect to the hull surface to the AMC. (3) An Electromagnetic surface Mounting Module (ESMM) holds SROCS on the Hull surface during the cleaning process. (4) A Biofouling Elimination Module (BEM) that has motorized rubbing discs that rotate to achieve the cleaning.

Multiple platforms can be synchronized and commanded to achieve the cleaning of larger ships and surfaces. A ground station can command multiple systems to work together using IoT technology over a satellite communication channel. Each station is transmitting its current location using a GPS navigation module. The ground station processes this information and sends positioning commands to each platform to prevent collision.

The system has two energy harvesting mechanisms, the first being the axial electromagnetic sliding strips that are mounted in the floating structure chassis and the body chassis. The harvesting process takes place whenever there is a relative motion between the two chassis due to water waves. The second harvesting mechanism is the linear electromagnetic actuators mounted between the system's transverse chassis, where the base is fixed at the floating chassis, and the harvesting head is fixed at the sliding body chassis.

As shown in FIG. 1A, the autonomous hull biofouling cleaning system 10 includes a floating platform 12 supported on pontoons 14. At least one anchor 16 is provided to stabilize the platform 12 during cleaning operations. A solar power assembly 18 including a solar panel and rechargeable batteries provides electrical power for the various modules mounted on the floating platform 12. A motorized reel 20 having a hose 22 is also mounted on the floating platform 12.

The hose 22 is connected to a submersible remotely operated cleaning system (SROCS) 24 for cleaning biofouling from hulls.

Figure 1B:
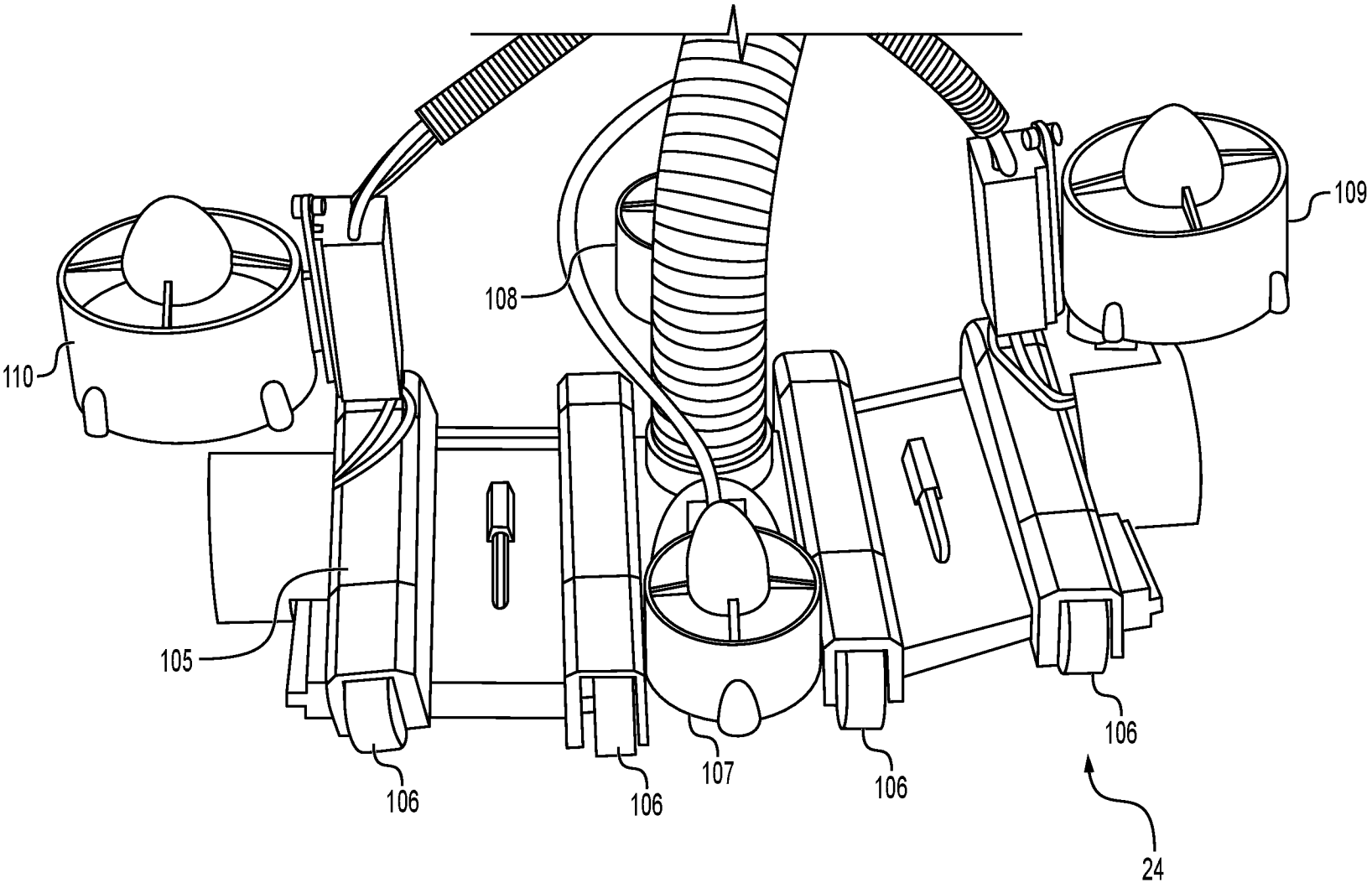
FIG. 1B is a perspective view of a submersible remotely operated cleaning system (SROCS).

As shown in FIG. 1B, the submersible remotely operated cleaning system (SROCS) 24 is an autonomous underwater robot equipped with an advanced motion control unit that enables the robot's orientation in the XYZ plane to be controlled. A nine-axis Inertial measurement unit (IMU) that comprises accelerometer, gyroscope, and magnetometer to detect rotation in three-dimensional space can be included therewith. Further, the SROCS 24 can include coiled magnets 105 for mounting and motorized wheels 106 permitting the SROCS 24 to move forwards and backwards. The SROCS 24 can also include a front motorized thruster 107 and a rear motorized thruster 108 to help balance the SROCS 24 and which are responsible for movement in the X-Y plane. Similarly, the SROCS 24 can also include a right motorized thruster 109 and a left motorized thruster 110 to help balance the SROCS 24 and which are responsible for movement in the Y-Z plane.

An ultrasound sensor measures the distance between the SROCS 24 and the hull surface 127, and when it reaches the surface, electromagnetic coils 105 are excited to mount the SROCS 24 on the hull surface 127, the thrusters 107, 108, 109, 110 are turned off, the cleaning process begins, and the motorized wheels 106 move forward and backward.

Figure 1C:
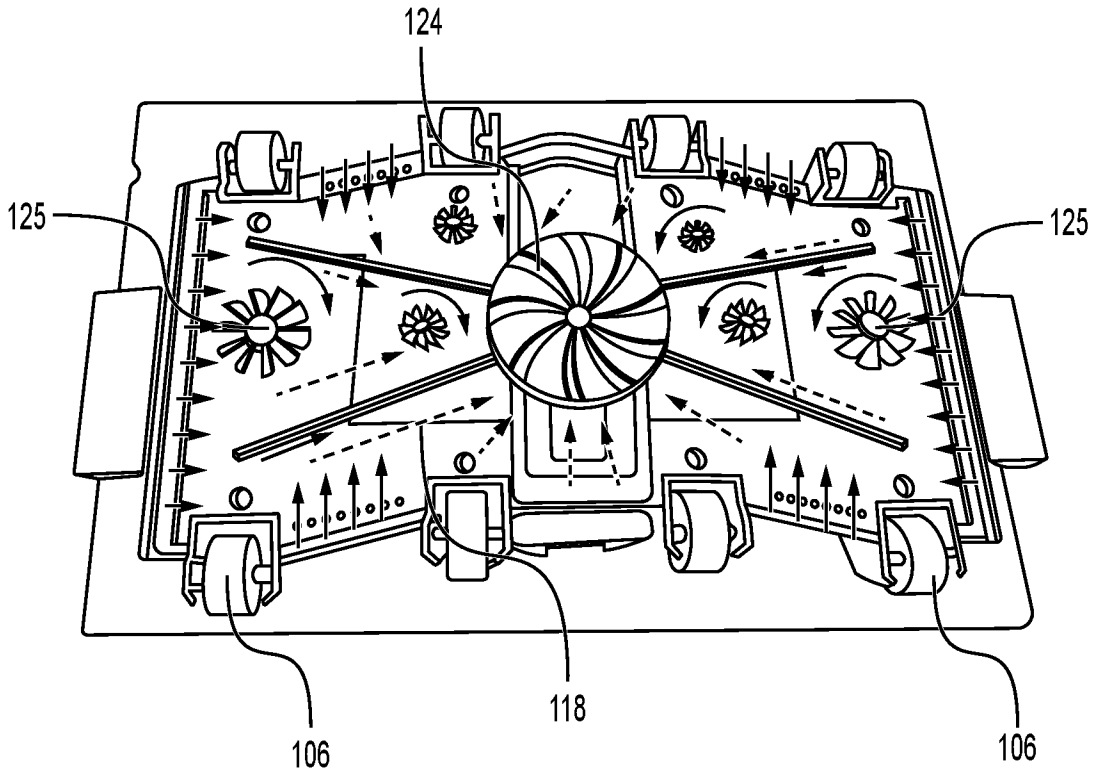
FIG. 1C is an interior view of a submersible remotely operated cleaning system (SROCS).
Figure 1D:
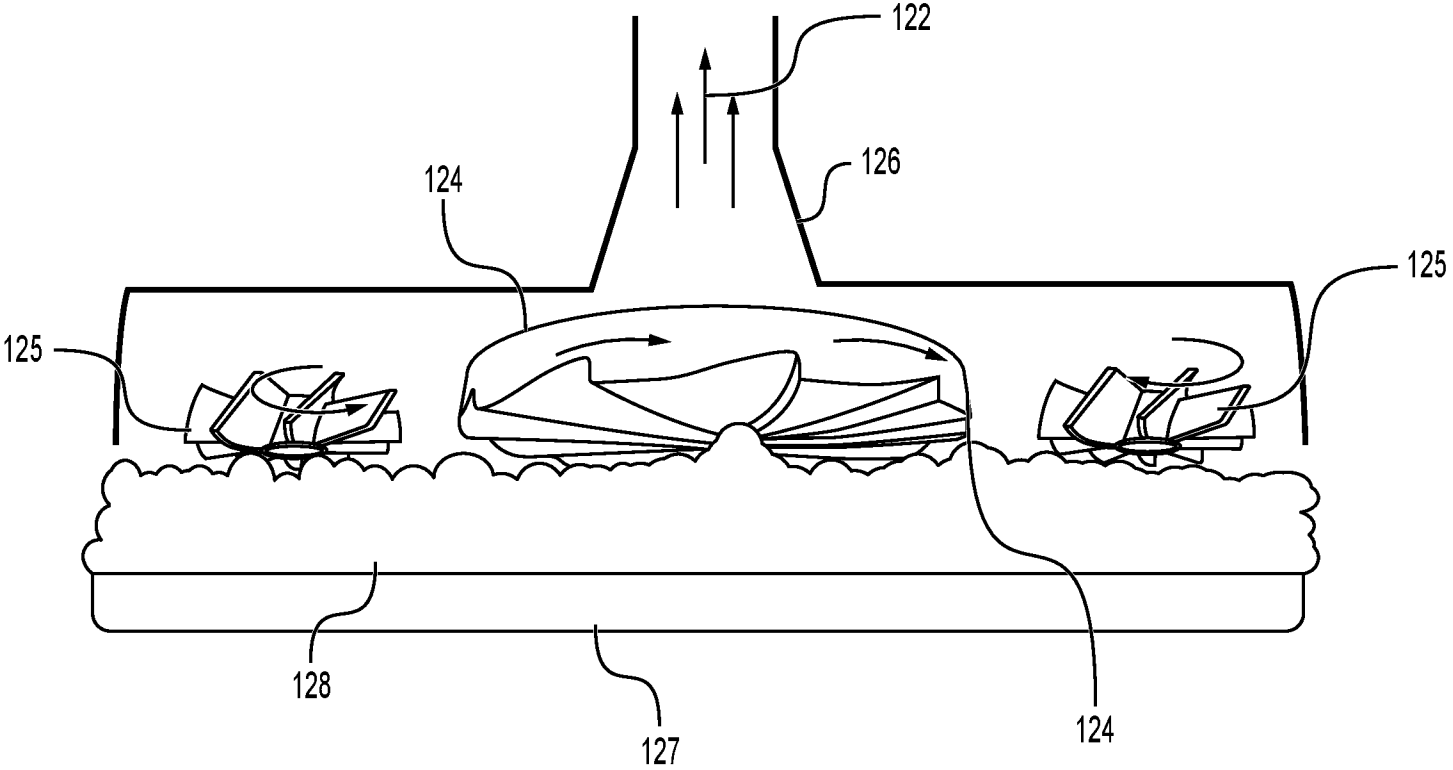
FIG. 1D is a view of the submersible remotely operated cleaning system (SROCS) in operation for removing biofouling and debris accumulated on a surface.

As shown in FIGS. 1C and 1D, a set of motorized main 124 and secondary 125 rubbing discs rotate to remove biofouling and debris accumulated on a surface 128 from the ship's exterior 127. Debris and biofouling 118 are guided to the center of the main disc 124, where the vacuum extraction module (VEM) 126 will suck the removed biofouling and debris 122 up.

Figure 2A:
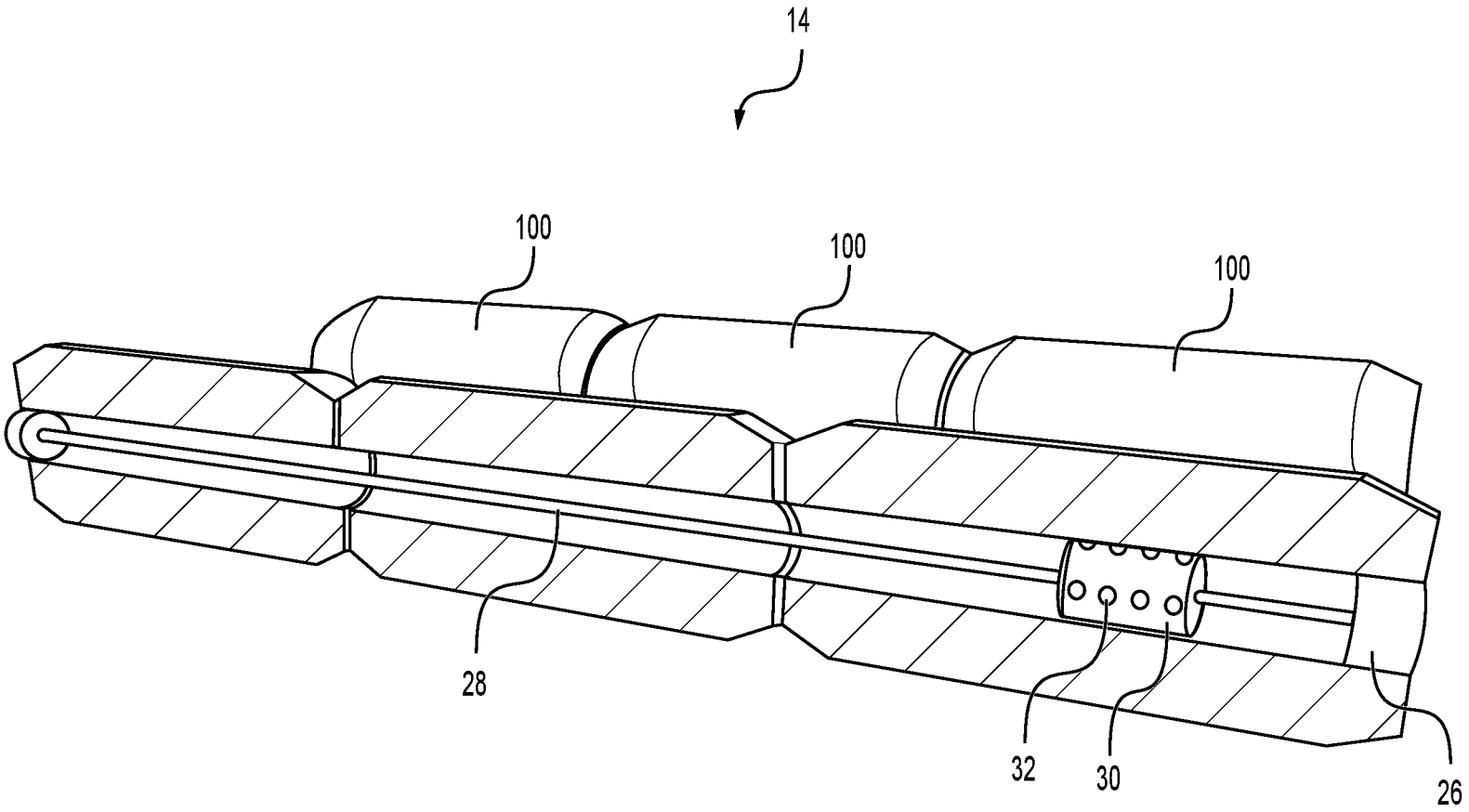
FIG. 2A is a diagrammatic side view in section of a pontoon supporting the floating platform, showing an axially sliding ballast mechanism.

As shown in FIG. 2A, the pontoons 14 include hollow cylinders 100 having a motor 26 connected to an axial screw drive 28, on which is mounted an axially sliding ballast 30, which can be adjusted to balance the floating platform 12. The sliding ballast 30 has ball bearings 32 mounted thereon for smooth sliding movement of the ballast 30.

Figure 2B:
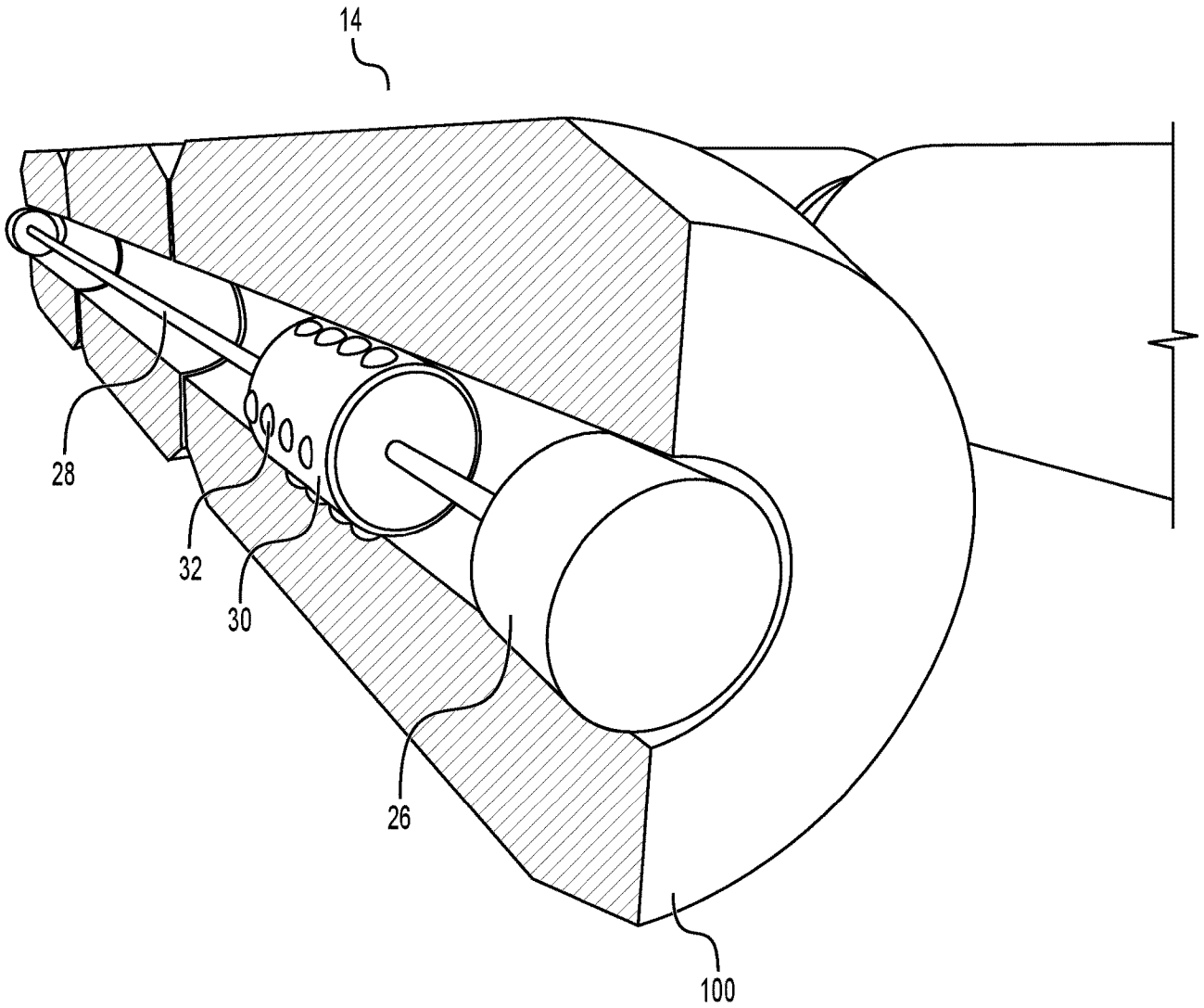
FIG. 2B is a section view of the pontoon supporting the floating platform, showing an axially sliding ballast mechanism.

As shown in FIG. 2B, the hollow shape of the floating cylinders 100 can be equipped with an axially sliding balancing mechanism for the right and the left side floating cylinders that includes an axially sliding ballast 30, which can be a cylindrical balancing weight connected with either an axial screw drive 28 connected at one end with the motor 26 to axially move the cylindrical balancing weight forward and backward based on the balancing requirements, or link to any axial mechanism like a steel cable to perform the same axial motion. The cylindrical balancing weight contains smooth sliding ball bearings 32 to reduce friction with the inner walls of the floating cylinders 100.

Figure 3A:
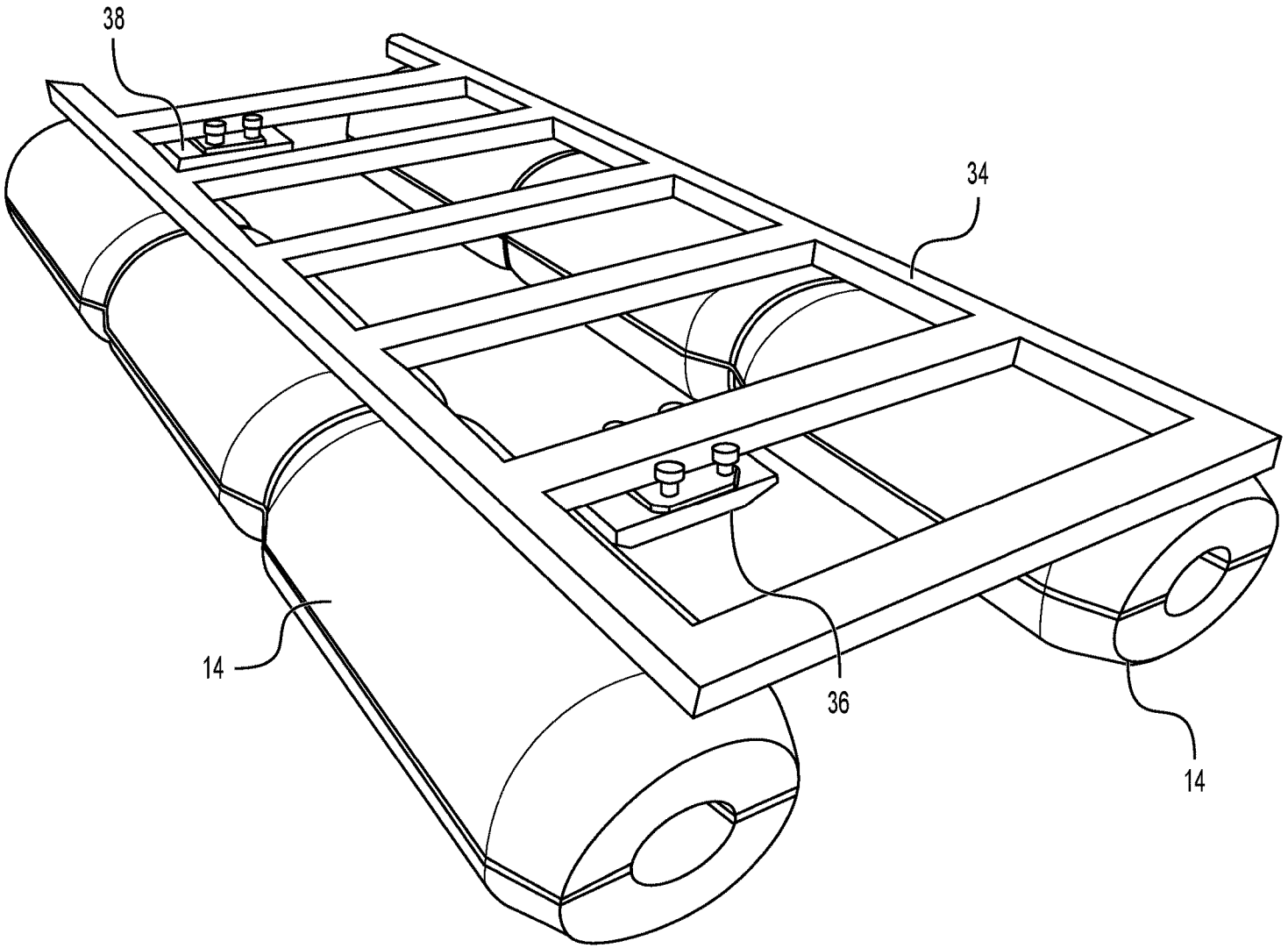
FIG. 3A is a perspective view of the chassis of the floating platform, the platform being removed to show front and rear sliding ballast.

As shown in FIG. 3A, the floating platform 12 is supported on a floating structure chassis 34, which has a front transverse sliding ballast 36 and a rear transverse sliding ballast 38. Together, the axial sliding ballasts 30 and the transverse sliding ballasts 36, 38 are used to stabilize the floating platform in the event of shifting weights collected during biofouling cleaning operations, as well as external forces, such as wind and waves.

Figure 3B:
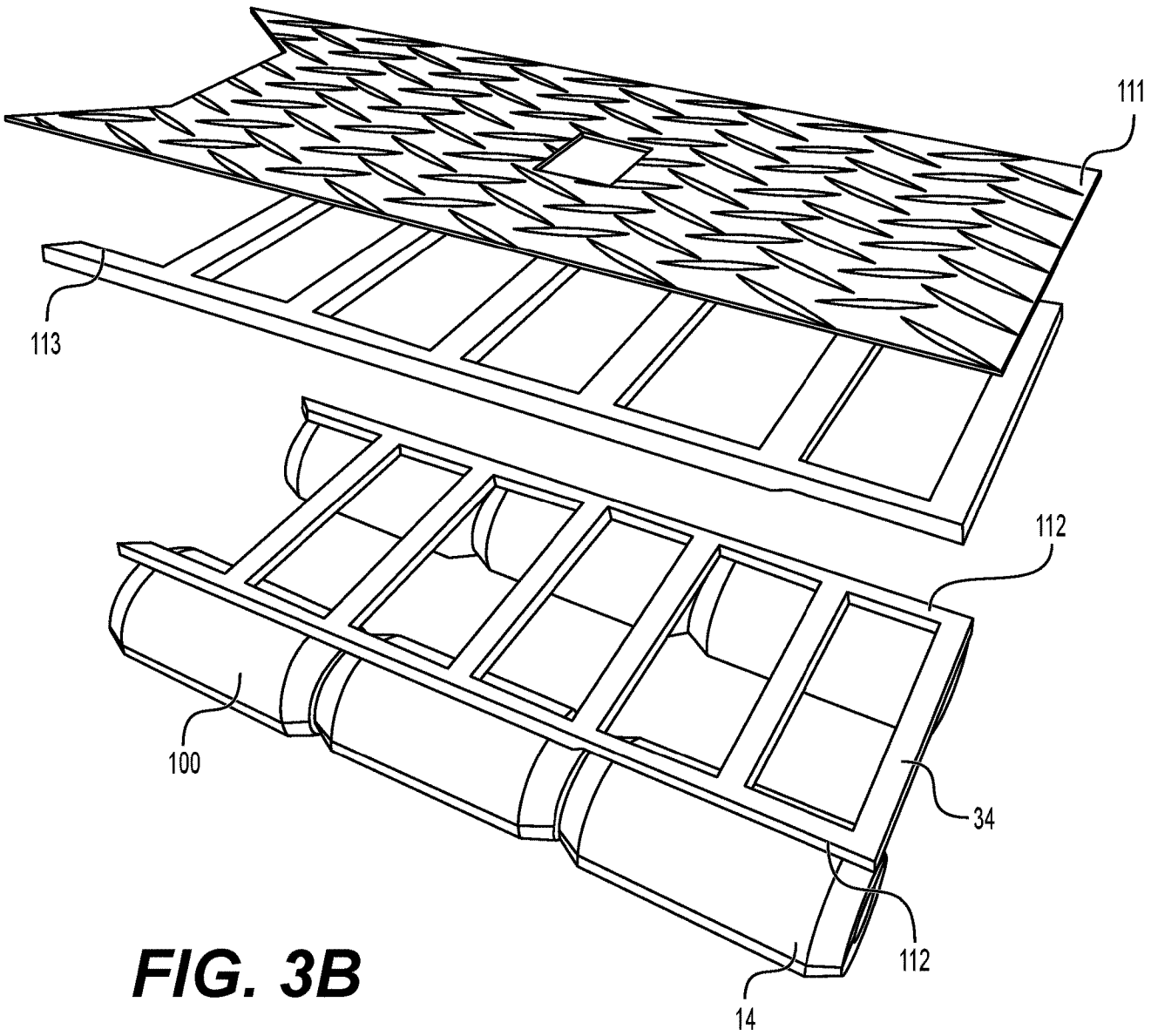
FIG. 3B is an exploded view of the floating platform.
Figure 3B:
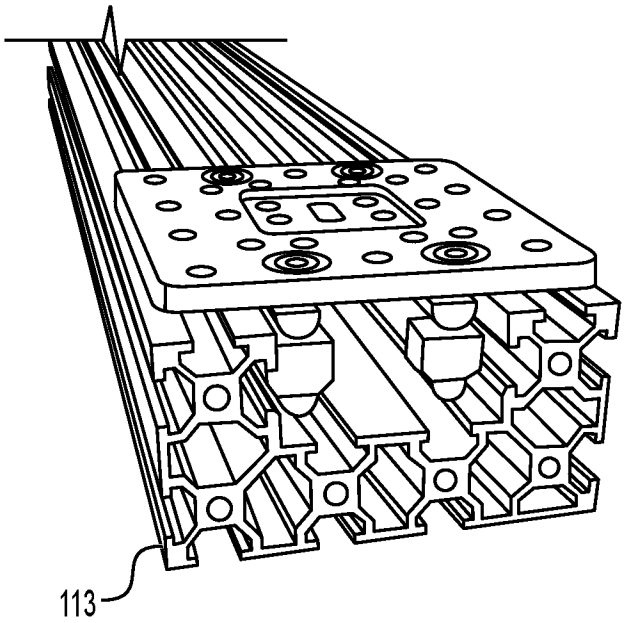
Figure 3B:
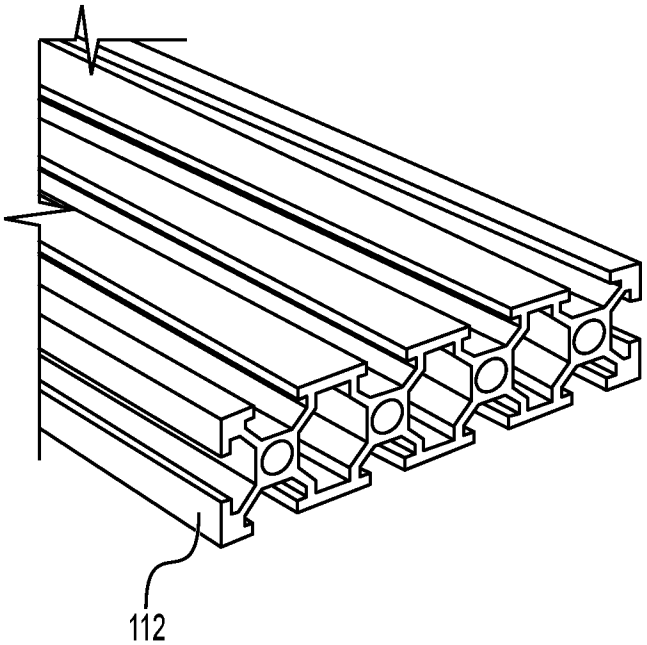

As shown in FIG. 3B, the floating platform 12 has two chassis, one floating structure chassis 34 connecting the floating cylinders 100, and the other body chassis 113 supports the main deck platform 111, or deck, which in a non-limiting example can be made of checkerplate. The two chassis can slide along each other through the sliding bracket to create a relative motion for the aim of energy harvesting. FIG. 3B also shows sectional views of the axial members 112 of the chassis 34 and of the body chassis 113.

Figure 3C:
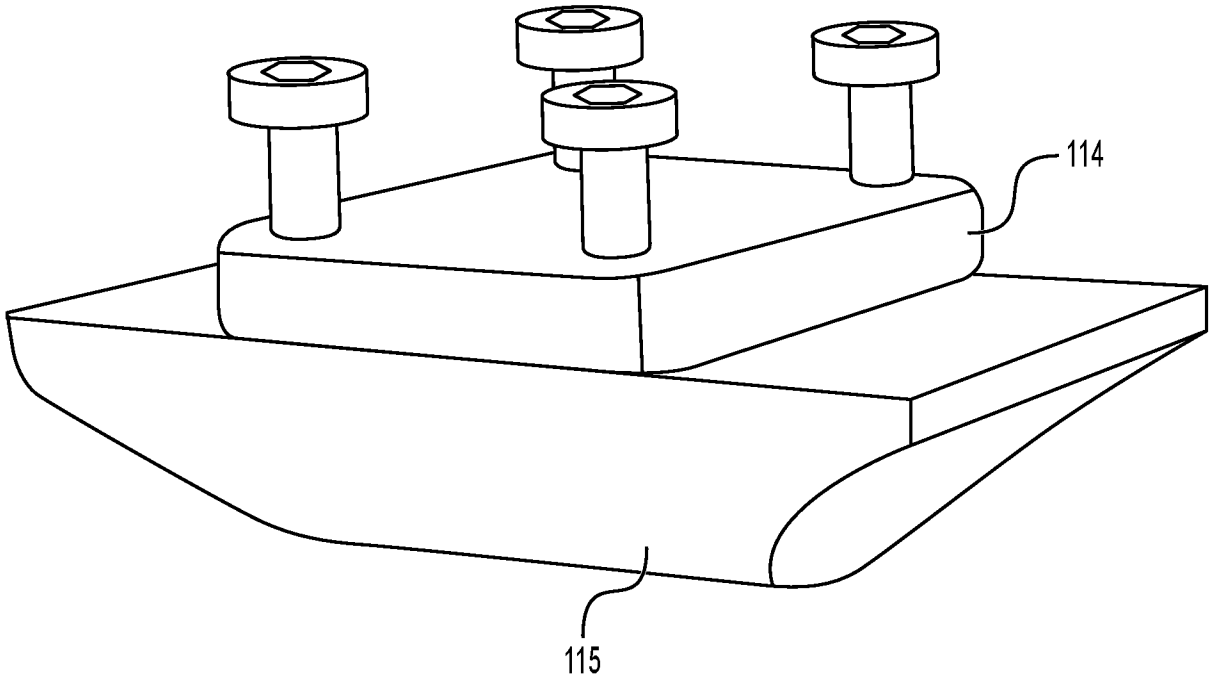
FIG. 3C is a perspective view of the transverse sliding ballasts.

FIG. 3C shows the transverse sliding ballasts 36, 38 comprising a sliding bracket 114 portion and a ballast 115 portion, collectively referred to as a transverse balancing mechanism. The chassis 34 has a transverse sliding ballast at each of the front 38 and the back 36 of the floating platform 12. The ballast 115 can have a curved shape to match the floating cylinder 100 profile.

Figure 3D:
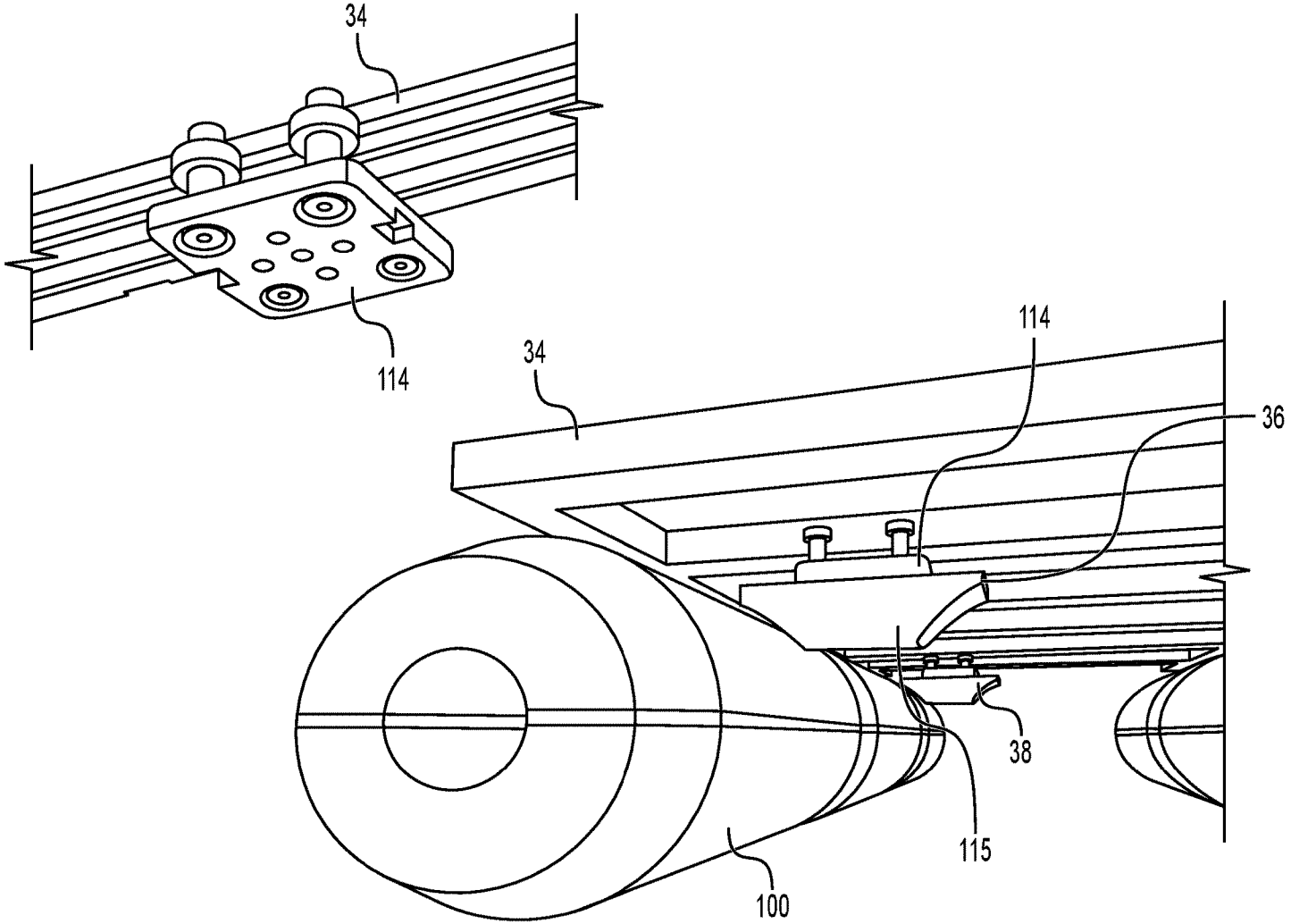
FIG. 3D is a front view of the transverse sliding ballasts as connected to the floating platform chassis.

FIG. 3D shows the rear transverse sliding ballast 36 as connected to the floating platform chassis 34. The sliding bracket 114 can slide along the chassis 34 to position the ballast 115 for proper balancing.

Figure 3E:
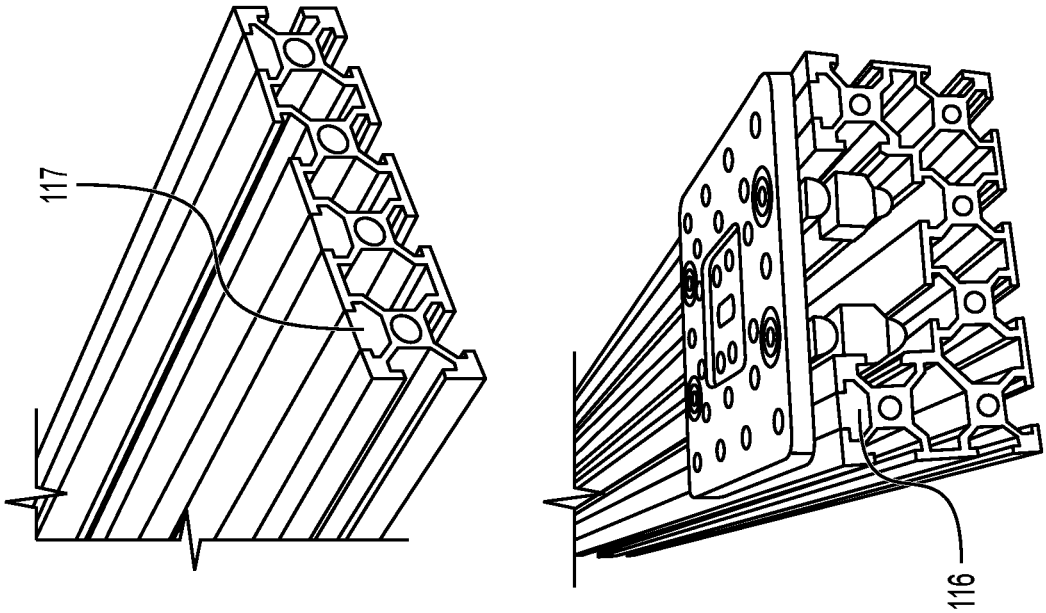
FIG. 3E is a set of several views of the energy harvesting mechanism.
Figure 3E:
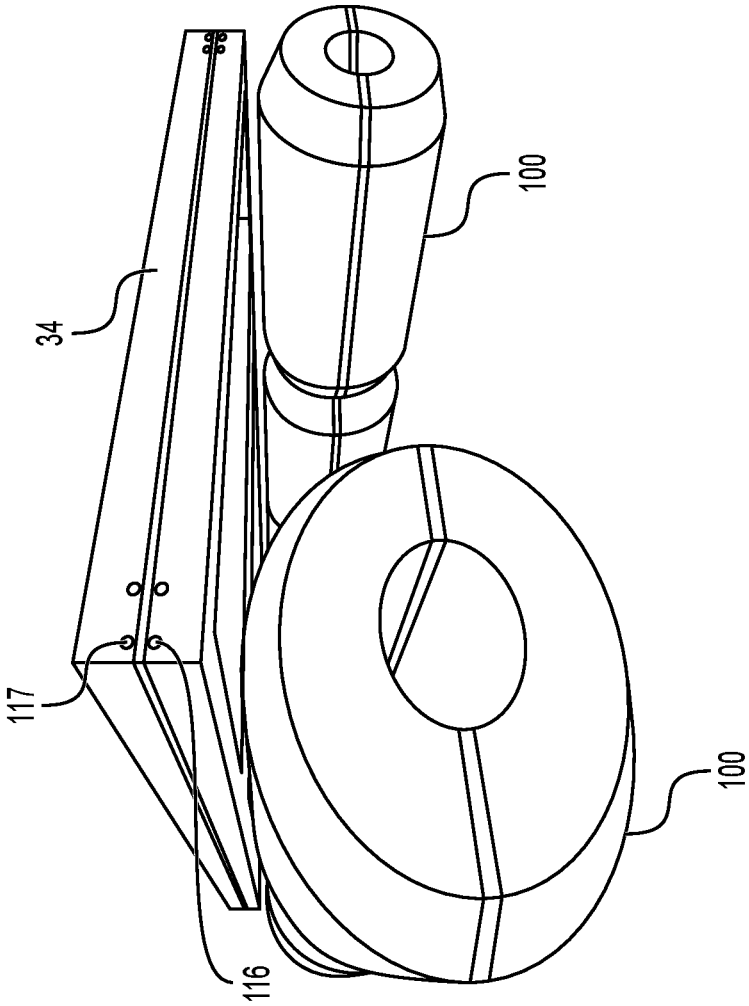
Figure 3E:
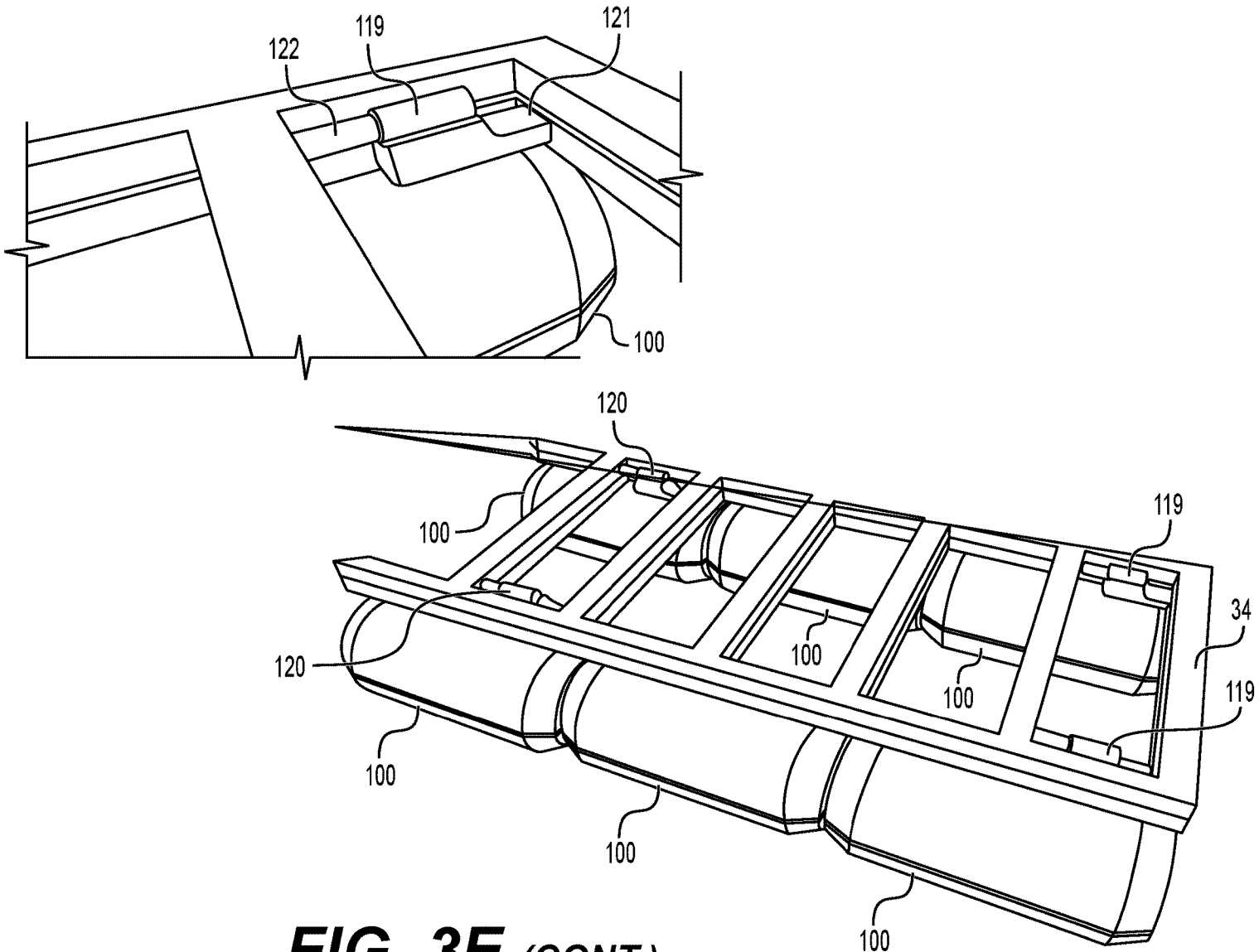

As shown in FIG. 3E, the system can have two energy harvesting mechanisms, first being the axial electromagnetic sliding strips 116, 117 that are mounted in the floating structure chassis 34 and the body chassis 113, respectively. The energy harvesting process can take place whenever there is a relative motion between the two chassis 34, 113 due to water waves.

The second energy harvesting mechanism is the linear electromagnetic actuators (LEA) 119, 120 mounted between the system's transverse chassis, where the base 121 is fixed at the floating chassis 34, and the energy harvesting head 122 is fixed at the sliding body chassis 113.

Figure 4:
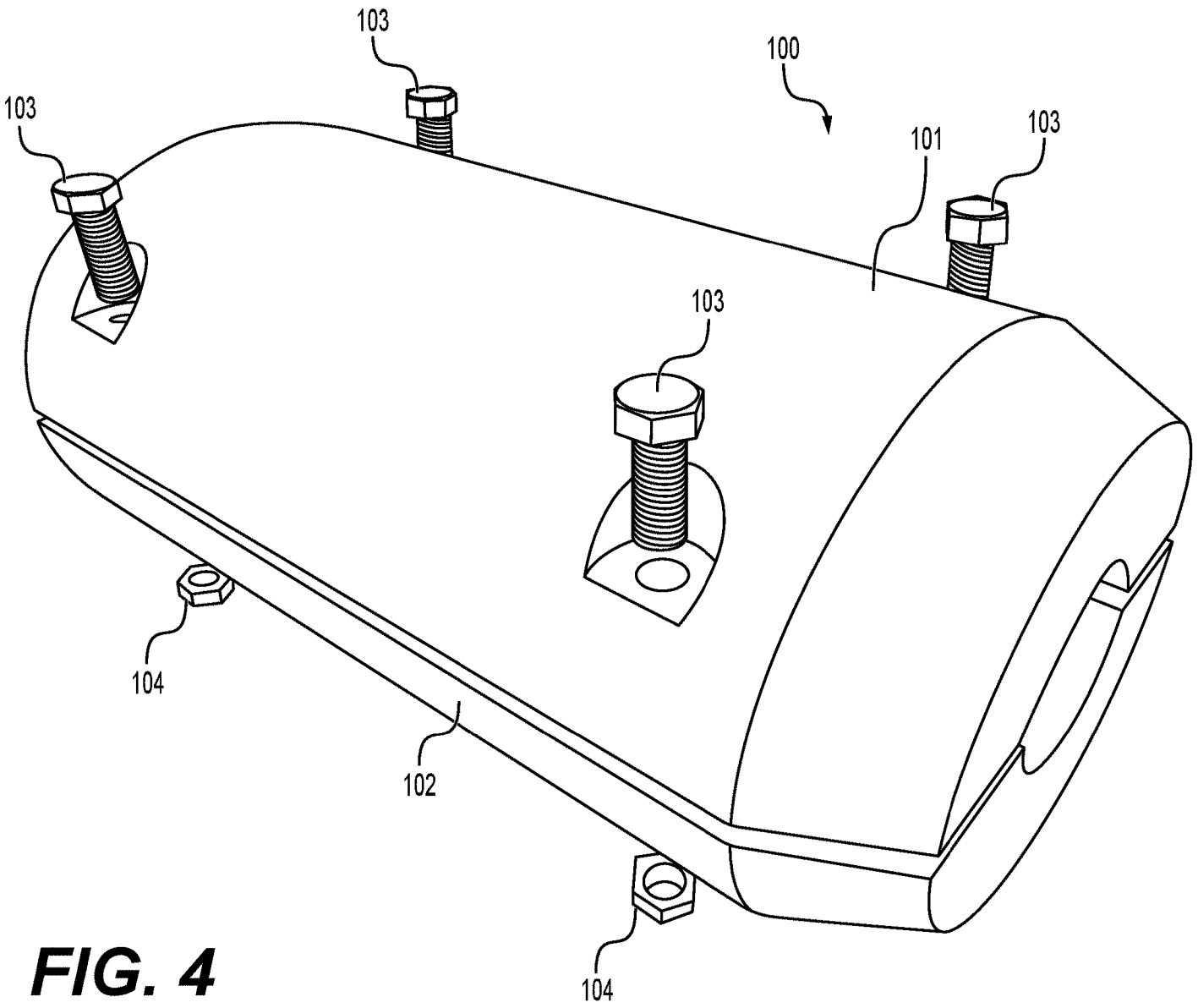
FIG. 4 is a perspective view of the floating platform configured as a hollow floating cylinder.

As shown in FIG. 4, each hollow floating cylinder 100 can have two halves, an upper half 101 and a lower half 102, connected by bolts 103 and nuts 104 for the maintenance, assembly, and disassembly process. In this configuration, the floating cylinder 100 is hollow from the inside and can be injected with foam. Ballast can be attached to the lower half 102 of the floating cylinder to perform the lower center of gravity of the system. The modular system can have multiple hollow floating cylinders 100 that are cascaded together by pipes sleeve and can be extended in the longitudinal and transverse directions. Floating cylinders 100 can be shaped in a transverse direction for a double, triple, and more columns, and connected by the system chassis to increase system payload capacity.

Figure 5:
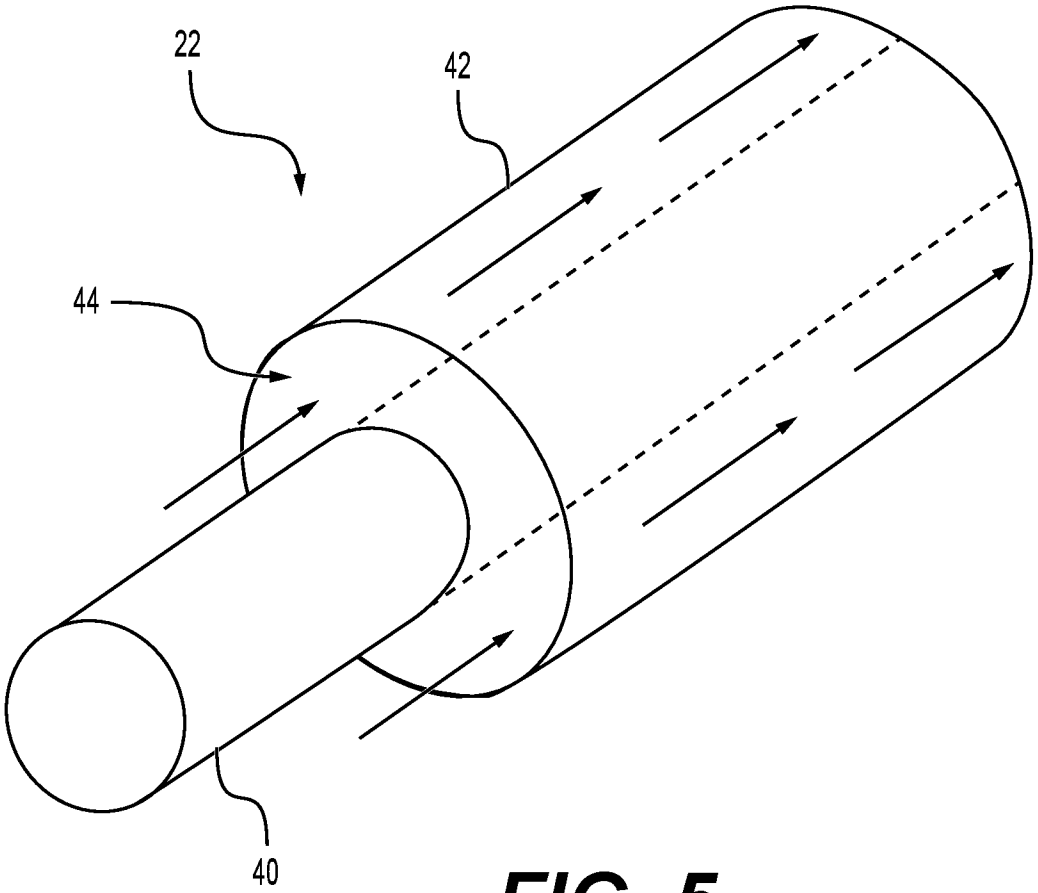
FIG. 5 is a schematic diagram of concentric hoses mounted on the motorized reel, including an inner hose for pumping ozone to the biofouling and an outer hose for vacuuming biofouling debris removed from the hull.

As shown in FIG. 5, the hose 22 is a pair of concentric hoses, including an inner hose 40 used to pump ozone from an ozone generating device on the floating platform 12 to the SROCS 24 apparatus for application to biofouling on the hull being cleaned through openings in the rubbing discs. The outer hose 42 defines an annular vacuum debris passage 44 between the inner hose 40 and the outer hose 42 that is connected to a vacuum module on the floating platform 12 for vacuuming biofouling debris (along with seawater) removed from the hull by the rubbing discs to modules on the floating platform 12 for further processing.

Figure 6:
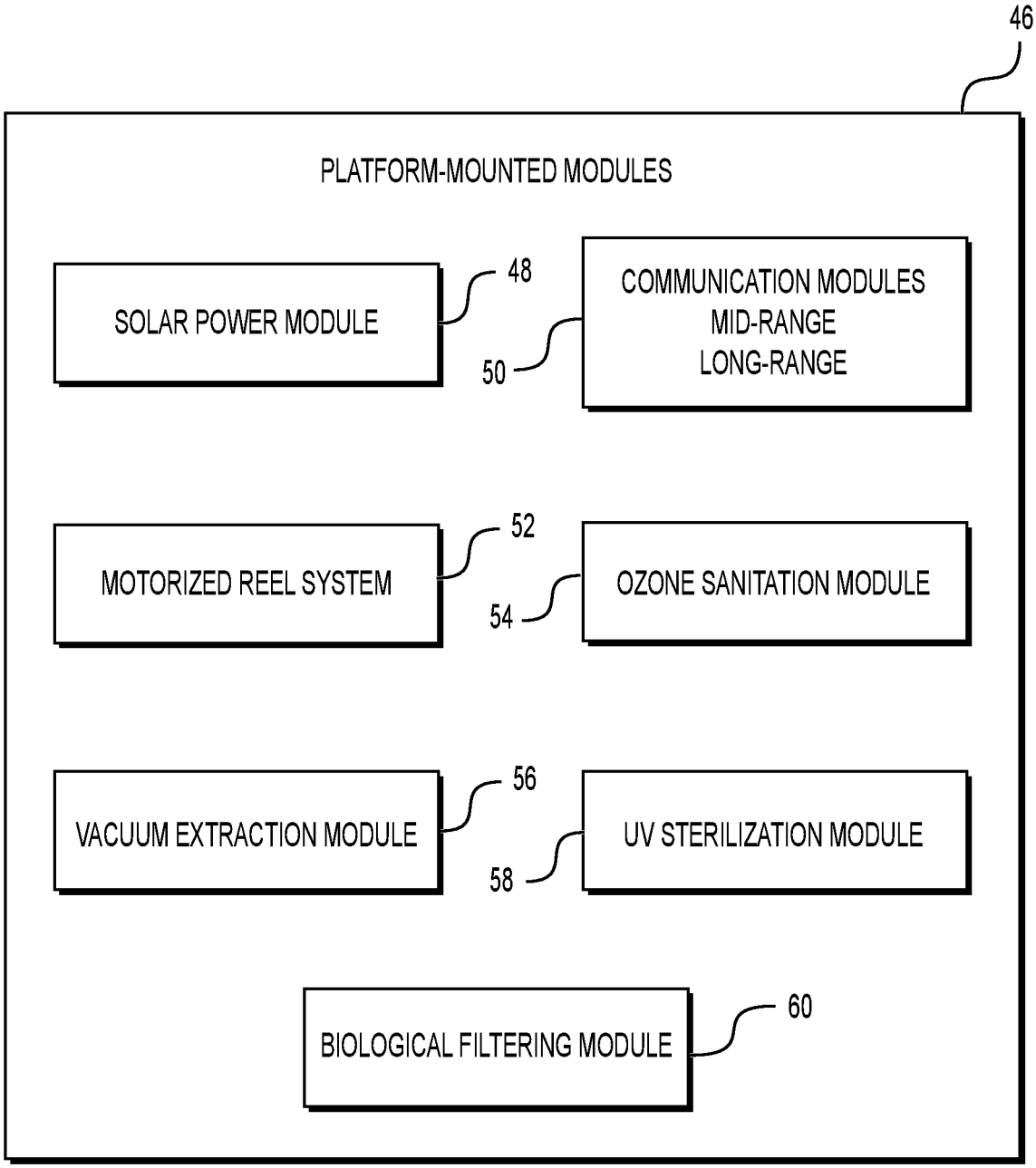
FIG. 6 is a block diagram of interconnected modules mounted on the floating platform.

As shown in FIG. 6, various interconnected platform-mounted modules 46 are mounted on the floating platform 12. These modules include a solar power module 48, which provides electrical power to each of the other modules. The platform-mounted modules 46 include communications modules 50, such as mid-range communications connected to control circuits for remote control of operations, e.g., by cell phone, and long-range communications connected to control circuits for remote operation through satellite communications, e.g., when using more than one autonomous hull biofouling cleaning system 10 to clean the hull of a boat or ship.

The platform-mounted modules 46 include the motorized reel system 52 for paying out and reeling in the hose 22 as needed, and an ozone sanitation module 54 having an ozonizer and air pump assembly for pumping ozone onto the biofouling as needed. A vacuum extraction module 56 provides for collecting biofouling debris mixed with seawater on the floating platform 12, where it is first processed by a UV sanitation module 58 providing irradiation by UV light at frequencies killing harmful biological organisms in the debris and seawater, and then by a biological filtering module 60 for removing particulate matter and discharging the cleaned seawater back into the body of water.

Figure 7:
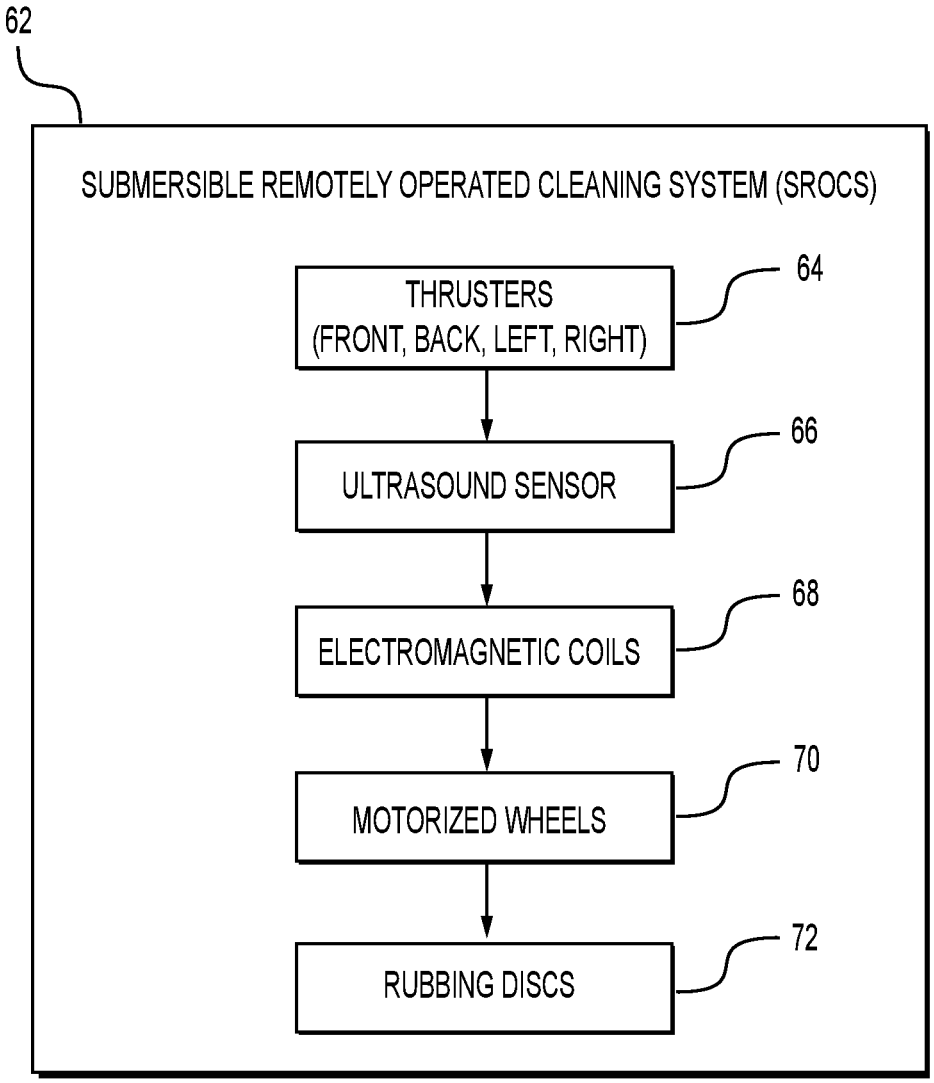
FIG. 7 is a block diagram of the submersible remotely operating cleaning system (SROCS).

As shown in FIG. 7, the submersible remotely operated cleaning system (SROCS) 62 is a robotic system for performing actual cleaning of the vessel hull. SROCS 62 includes thrusters 64 (front, back, left, and right) for moving the robotic unit from the floating platform 12 to the hull when within range, as guided by an ultrasound sensor 66 detecting distance and direction. When close enough to the hull, electromagnetic coils 68 are activated to attach SROCS 62 to the hull, and motorized wheels 70 provide for local, fine movement over the biofouling on the hull, as needed. Finally, rubbing discs 72 provide an outlet for the ozone pumped through the hose 22, perform actual removal of the biofouling from the hull, and provide a central collection area for removal of the biofouling debris through the vacuum debris passage 44 in the hose 22.

Thus, the autonomous hull biofouling cleaning system 10 provides a complete and efficient system for autonomous or semi-autonomous cleaning of biofouling from the hulls of waterborne vessels.

It is to be understood that the autonomous hull biofouling cleaning system is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An autonomous hull biofouling cleaning system, comprising:

a floating platform capable of navigation to a waterborne vessel having a hull having biofouling accumulated thereon;

a motorized hose reel mounted on the floating platform;

an ozone sanitation module mounted on the floating platform, the ozone sanitation module having an ozonizer for generating ozone and an air pump for pumping the ozone;

a vacuum extraction module having a vacuum pump;

concentric hoses mounted on the motorized hose reel, the concentric hoses each having a first end and a second end, the concentric hoses including an inner hose having its first end connected to the ozone sanitation module and an outer hose defining an annular vacuum debris passage between the inner hose and the outer hose, the first end of the outer hose being connected to the vacuum extraction module; and a submersible remotely operated cleaning system (SROCS), the second ends of the concentric hoses being connected to the SROCS, the SROCS having:

a plurality of thrusters for navigation from the floating platform to the hull of the waterborne vessel;

electromagnetic coils for attaching the SROCS to the hull of the waterborne vessel; and rubbing discs for removing the biofouling from the hull of the waterborne vessel, the rubbing discs providing an outlet for pumping the ozone from the inner hose onto the biofouling and a central area for extracting biofouling debris removed from the hull into the annular vacuum debris passage for passage to the floating platform.

2. The autonomous hull biofouling cleaning system according to claim 1, wherein said floating platform has a chassis and right and left pontoons mounted on the chassis, each of the pontoons having a hollow cylinder defined therein having opposing ends, each of the cylinders having a motor mounted at one of the opposing ends, a screw drive attached to the motor and extending to the opposing end of the cylinder, and an axially sliding ballast mounted on the screw drive, the axially sliding ballast being movable forward and rearward in the cylinder by rotation of the screw drive by the motor.

3. The autonomous hull biofouling cleaning system according to claim 2, wherein each said axially sliding ballast has a plurality of ball bearings mounted thereon for smooth sliding motion of the axially sliding ballast in the corresponding cylinder.

4. The autonomous hull biofouling cleaning system according to claim 2, wherein said chassis has a forward and a rear transversely sliding ballast mounted thereon, the axially and transversely sliding ballasts stabilizing said floating platform under varying load, wind, and wave conditions.

5. The autonomous hull biofouling cleaning system according to claim 1, further comprising a UV sterilization module connected to said vacuum extraction module, the UV sterilization module irradiating a mixture of biofouling debris and seawater with UV light at frequencies killing any harmful biological organisms entrained in the mixture.

6. The autonomous hull biofouling cleaning system according to claim 5, further comprising a biological filtering module connected to aid UV sterilization module, the biological filtering module removing particulate matter remaining in the mixture of biofouling debris and seawater after irradiation by the UV light and discharging the filtered seawater back into water said floating platform is navigating on.

7. The autonomous hull biofouling cleaning system according to claim 1, further comprising a solar power module mounted on said floating platform, the solar power module having a solar panel and rechargeable batteries connected to the solar panel, the solar power module supplying renewable electrical power to the modules mounted on said floating platform.

8. The autonomous hull biofouling cleaning system according to claim 1, further comprising communications modules mounted on said floating platform, the communications modules including mid-range and long-ranges communications including control circuits for remote autonomous and semi-autonomous control of said floating platform, the modules mounted thereon, and said submersible remotely operated cleaning system (SROCS).

9. The autonomous hull biofouling cleaning system according to claim 1, wherein said submersible remotely operated cleaning system (SROCS) further comprises an ultrasound sensor configured for providing distance and direction to the waterborne vessel having a hull having biofouling accumulated thereon.

10. The autonomous hull biofouling cleaning system according to claim 1, wherein said submersible remotely operated cleaning system (SROCS) further comprises motorized wheels for moving the rubbing discs of said SROCS across the hull to clean the biofouling from the hull.

11. The autonomous hull biofouling cleaning system according to claim 1, comprising a plurality of said floating platforms remotely coordinated for cleaning biofouling from a single large hull.

* * * * *